US008844228B2

(12) United States Patent
Hamel

(10) Patent No.: US 8,844,228 B2
(45) **Date of Patent: *Sep. 30, 2014**

(54) DRY-CAST CONCRETE BLOCK

(75) Inventor: Denis Hamel, Baie d'Urfé (CA)

(73) Assignee: Oldcastle Building Products Canada, Inc. (CA)

( * ) Notice: Subject to any disclaimer, the term of this patent is extended or adjusted under 35 U.S.C. 154(b) by 2510 days.

This patent is subject to a terminal disclaimer.

(21) Appl. No.: 11/452,519

(22) Filed: Jun. 14, 2006

(65) Prior Publication Data

US 2007/0289247 A1 Dec. 20, 2007

(51) Int. Cl.

| | |
|---|---|
| ***E04C 1/00*** | (2006.01) |
| ***B28B 7/38*** | (2006.01) |
| ***B28B 7/00*** | (2006.01) |
| ***E04B 2/04*** | (2006.01) |
| ***B28B 7/34*** | (2006.01) |
| *E04B 2/02* | (2006.01) |
| *B28B 7/24* | (2006.01) |

(52) U.S. Cl.

CPC ..... *E04B 2/04* (2013.01); *E04B 2002/0269* (2013.01); *B28B 7/386* (2013.01); *B28B 7/24* (2013.01); *E04C 1/00* (2013.01); *B28B 7/0073* (2013.01); *B28B 7/346* (2013.01); *B28B 7/007* (2013.01)

USPC ..... 52/311.1; 52/316; 52/596; 52/598

(58) Field of Classification Search

USPC ..... 52/311.1, 316, 596, 598; 428/15

See application file for complete search history.

(56) References Cited

U.S. PATENT DOCUMENTS

| | | | | |
|---|---|---|---|---|
| 4,001,361 | A * | 1/1977 | Unruh | 52/309.1 |
| 4,896,999 | A | 1/1990 | Ruckstuhl | |
| 5,131,202 | A * | 7/1992 | Ball | 52/596 |
| 5,232,646 | A * | 8/1993 | Nasvik et al. | 428/15 |
| 5,282,700 | A | 2/1994 | Rodrique | |
| 5,350,256 | A | 9/1994 | Hammer | |
| 5,474,405 | A | 12/1995 | Anderson et al. | |
| 5,528,873 | A | 6/1996 | Correia et al. | |
| 5,535,563 | A * | 7/1996 | Brown et al. | 52/316 |
| 5,688,078 | A | 11/1997 | Hammer | |
| 5,707,184 | A | 1/1998 | Anderson et al. | |
| 5,788,423 | A | 8/1998 | Perkins | |
| 5,820,304 | A | 10/1998 | Sorheim et al. | |
| 6,062,772 | A | 5/2000 | Perkins | |
| 6,881,463 | B2 * | 4/2005 | Riccobene | 52/311.2 |
| D511,578 | S | 11/2005 | Mugge et al. | |
| D529,628 | S | 10/2006 | Mugge et al. | |
| 7,140,867 | B2 | 11/2006 | Scherer et al. | |
| D538,946 | S | 3/2007 | Mugge et al. | |
| 7,208,112 | B2 | 4/2007 | Scherer | |
| D581,548 | S | 11/2008 | Mugge et al. | |
| 2008/0145148 | A1 * | 6/2008 | Hamel | 404/41 |

OTHER PUBLICATIONS

Lock + Load, Retaining Walls, www.lock-lead.com, known to Applicant no later than Jun. 13, 2006, 2 pages.

Recon, Retaining Wall Systems, The ReCon Wall System . . . , Recon Wall System, Inc., www.reconwalls.com, known to Applicant no later than Jun. 13, 2006, 4 pages.

Idea Book, Courtyard Collection, Create The Classic Look of Stone Walls, Allan Block, allblock.com, Allan Block Corporation, 12 pages, Dec. 2005.

Keystone, Retaining Wall Systems, Retaining Execellence, Imagine the Possibilities, Keystone Retaining Walls Systems, Inc., www.keystonewalls.com, 20 pages, Dec. 2004.

Redi-Rock International LLC, What's the Big Idea? More Red-Rock Solutions, www.redi-rock.com, known to Applicant not later than Jun. 13, 2006, 4 pages.

Sound, Not What You'd Expect From The Typical Strong, Silent Type, The First And Only Fully Engineered Precast Bloc, Stone Strong Systems, www.stonestrong.com, known to Applicant no later than Jun. 13, 2006, 2 pages.

WestBlocksytems, GravityStone, http://nurserystone.com/index.html, dated Jun. 13, 2006, 3 pages.

* cited by examiner

*Primary Examiner* — Joshua J Michener
*Assistant Examiner* — Matthew J Smith
(74) *Attorney, Agent, or Firm* — Kilpatrick Townsend & Stockton LLP

(57) ABSTRACT

A dry-cast concrete block is provided. The dry-cast concrete block comprises a surface to be exposed, at least a portion of the surface having a cast texture with a natural stone appearance. The cast texture may have a surface level difference of greater than 4 mm. In one example of implementation, the dry-cast concrete block may be a paving unit, in which case the surface level difference may be greater than 6 mm, such as between 6 mm and 12 mm. In another example of implementation, the dry-cast concrete block may be a wall construction unit, in which case the surface level difference may be greater than 15 mm, such as between 15 mm and 25 mm. Each of a plurality of points of the cast texture may define a respective texture angle between 75° and 90°. The cast texture may comprise at least one valley each having a respective depth greater than 4 mm. A process for manufacturing such a concrete block is also provided.

32 Claims, 14 Drawing Sheets

DRY-CAST CONCRETE BLOCK

FIELD OF THE INVENTION

The present invention relates to dry-cast concrete blocks with a natural stone appearance and to a process for manufacturing such concrete blocks.

BACKGROUND

Concrete blocks intended to serve as paving units (e.g., pavers, paving tiles, etc.), wall construction units (e.g., masonry units, retaining wall units, etc.), ornamental blocks, steps, and other landscaping elements are sometimes provided with a natural stone appearance over an exposed portion thereof. Such concrete blocks can then be assembled into paved surfaces, walls or other structures that have a natural and aesthetic look.

Depending on their constituent concrete, concrete blocks can be broadly divided into dry-cast concrete blocks and wet-cast concrete blocks. Different processes are used to manufacture these two types of concrete blocks and, in particular, to provide them with a natural stone appearance.

Wet-cast concrete blocks may have a natural stone appearance realized directly during casting, but relatively long production times and requirements for numerous molds typically render impractical their efficient mass-production. For their part, dry-cast concrete blocks normally have relatively short production times and require only one or a few molds, which facilitates their mass-production. However, these relatively short production times impose constraints on a degree of surface irregularity that may be imparted to dry-cast concrete blocks during casting, thereby preventing realization of a natural stone appearance during casting. Dry-cast concrete blocks are thus typically subjected after casting to a mechanical artificial aging/weathering process (e.g., tumbling, splitting/breaking, object impacting, etc.) to realize desired natural stone characteristics, which decreases production efficiency.

There is therefore a need for dry-cast concrete blocks for which a natural stone appearance is obtained during casting.

SUMMARY OF THE INVENTION

As embodied and broadly described herein, the invention provides a dry-cast concrete block. The dry-cast concrete block comprises a surface to be exposed, at least a portion of the surface having a cast texture with a natural stone appearance.

In one embodiment, the cast texture may have a surface level difference of greater than 4 mm.

In one example of implementation, the dry-cast concrete block may be a paving unit. The surface level difference may be greater than 6 mm, such as between 6 mm and 12 mm.

In another example of implementation, the dry-cast concrete block may be a wall construction unit. The surface level difference may be greater than 15 mm, such as between 15 mm and 25 mm.

In one embodiment, each of a plurality of points of the cast texture may define a respective texture angle between 75° and 90°.

In one embodiment, the cast texture may comprise at least one valley each having a respective depth greater than 4 mm.

In one embodiment, the cast texture may comprise a pattern of cast relief elements configured to enable a second concrete block to be supported thereon.

In one embodiment, the at least a portion of the surface may be a first portion of the surface and the cast texture may be a first cast texture. The surface may comprise (1) a second portion with a second cast texture having a natural stone appearance and (2) a third portion without a cast texture having a natural stone appearance and that separates the first portion and the second portion.

As embodied and broadly described herein, the invention also provides a process comprising:

- providing no-slump concrete into a cavity of a mold, the cavity being configured to form a concrete block comprising a surface to be exposed with at least a portion that has a cast texture with a natural stone appearance;
- consolidating the no-slump concrete to form the concrete block in the cavity of the mold; and
- removing the concrete block from the cavity of the mold.

In one embodiment, the cavity of the mold has a surface with at least a portion having a texture defining a surface level difference of greater than 4 mm.

In one embodiment, the process may further comprise cleaning the cavity of the mold using a fluid. In another embodiment, the process may further comprise cleaning the cavity of the mold using a fluid and a brush.

In one embodiment, the cavity of the mold is a first cavity, the concrete block is a first concrete block, and the cast texture is a first cast texture having a first configuration. The mold comprises a second cavity configured to form a second concrete block comprising a surface to be exposed with at least a portion that has a second cast texture with a natural stone appearance, the second cast texture having a second configuration different from the first configuration. The first cavity has a first volume and the second cavity has a second volume substantially corresponding to the first volume. The process may comprise providing no-slump concrete simultaneously into the first and second cavities of the mold.

In one embodiment, the cavity of the mold is a first cavity, the concrete block is a first concrete block, and the cast texture is a first cast texture having a first configuration. The mold comprises a second cavity configured to form a second concrete block comprising a surface to be exposed with at least a portion that has a second cast texture with a natural stone appearance, the second cast texture having a second configuration different from the first configuration. The first cavity has a first volume per unit area and the second cavity has a second volume per unit area substantially corresponding to the first volume per unit area. The process may comprise providing no-slump concrete simultaneously into the first and second cavities of the mold.

These and other aspects and features of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the accompanying drawings, in which.

It is to be expressly understood that the description and drawings are only for the purpose of illustrating certain embodiments of the invention and are an aid for understanding. They are not intended to be a definition of the limits of the invention.

DETAILED DESCRIPTION OF EMBODIMENTS

Figure 1:
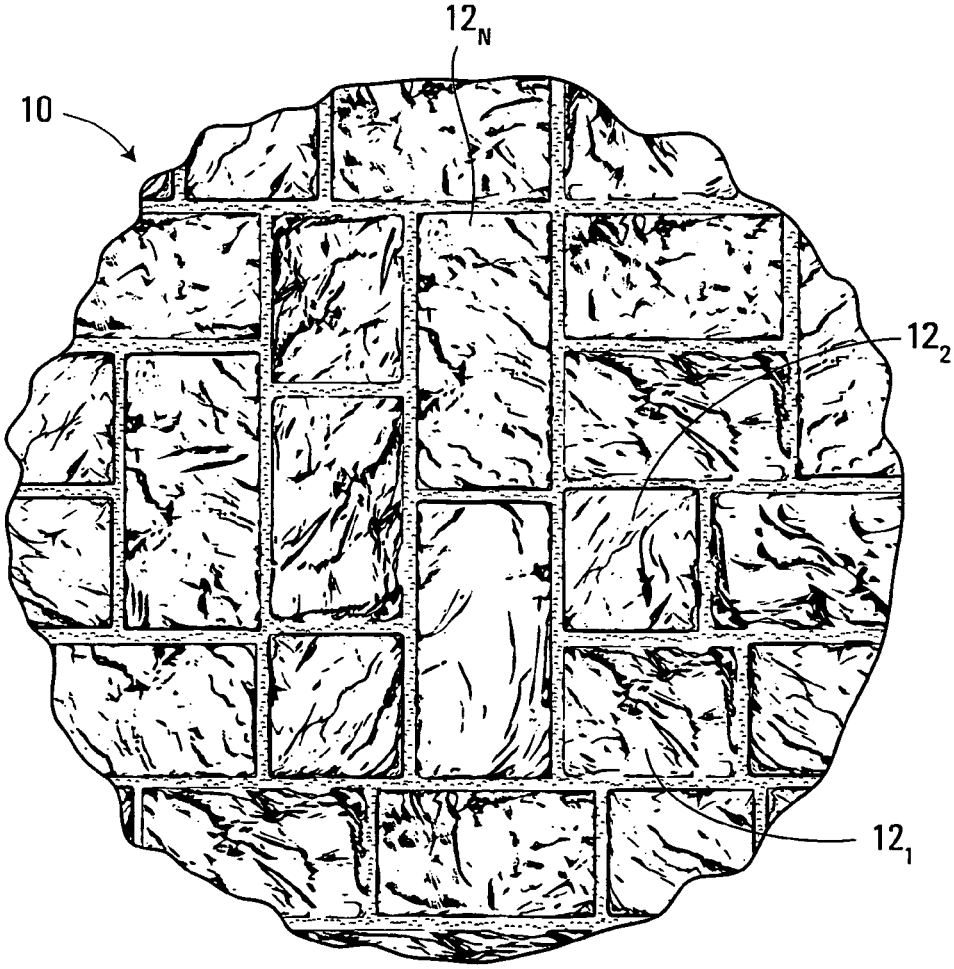
FIG. 1 shows a paved surface comprising a plurality of concrete blocks in accordance with a first embodiment of the invention.

FIG. 1 shows a paved surface 10 comprising a plurality of concrete blocks $\mathbf{12}_1 \ldots \mathbf{12}_N$ in accordance with a first embodiment of the invention. In this embodiment, the concrete blocks $\mathbf{12}_1 \ldots \mathbf{12}_N$ are pavers. In other embodiments, the concrete blocks $\mathbf{12}_1 \ldots \mathbf{12}_N$ may be paving tiles or any other type of paving units. Also, in this example of implementation, the concrete blocks $\mathbf{12}_1 \ldots \mathbf{12}_N$ have various shapes and sizes and are arranged in various laying patterns. Generally, the concrete blocks $\mathbf{12}_1 \ldots \mathbf{12}_N$ may have any desired shape and size, and may be arranged in any desired laying pattern.

Figure 2:
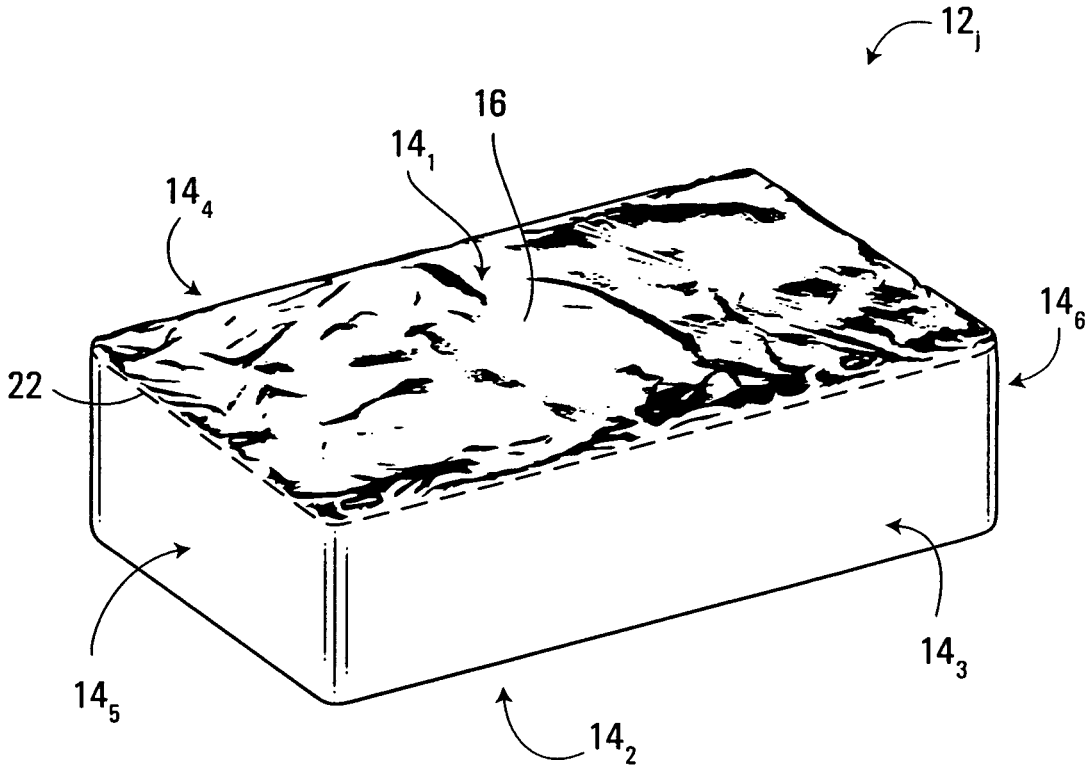
FIG. 2 shows a perspective view of a given concrete block of the concrete blocks shown in FIG. 1.
Figure 3:
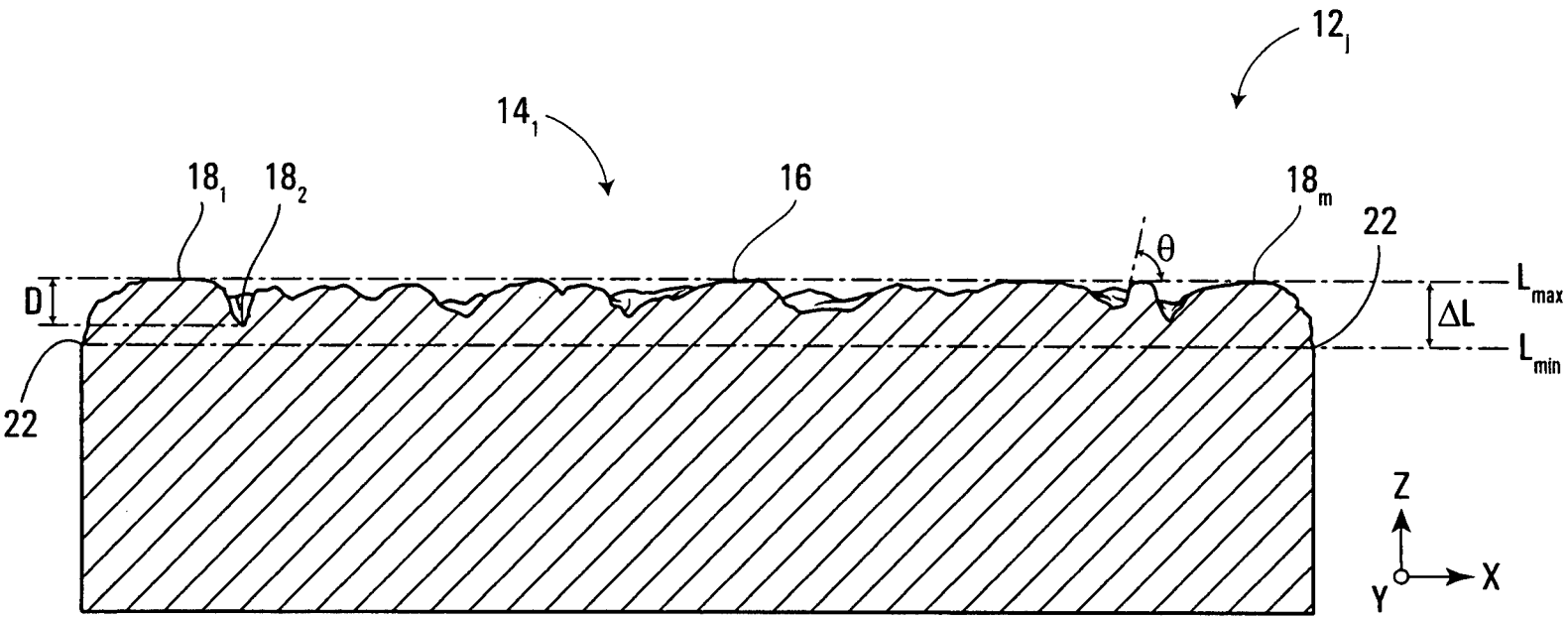
FIG. 3 shows a cross-sectional view of the concrete block of FIG. 2, illustrating a cast texture of a surface portion of the concrete block that has a natural stone appearance.

Referring to FIGS. 2 and 3, there is shown a given concrete block $\mathbf{12}_j$ of the concrete blocks $\mathbf{12}_1 \ldots \mathbf{12}_N$ ($1 \leq j \leq N$). The concrete block $\mathbf{12}_j$ is a dry-cast concrete block, i.e., it is made of no-slump concrete. No-slump concrete (also known as zero-slump concrete) can be viewed as concrete with a slump of 6 mm or less. It will be appreciated that various types of no-slump concrete are possible and may be used.

The concrete block $\mathbf{12}_j$ can be said to have a generally rectangular prism configuration with six surfaces $\mathbf{14}_1 \ldots \mathbf{14}_6$. The concrete block $\mathbf{12}_j$ may have, however, any desired configuration with any desired number of surfaces.

The surface $\mathbf{14}_1$ is intended to be exposed when the concrete block $\mathbf{12}_j$ is placed in the paved surface 10. At least a portion 16 of the surface $\mathbf{14}_1$ has a cast texture having a natural stone appearance, i.e., an aged, worn, or weathered appearance that resembles natural stone. As described later on, the cast texture of the portion 16 of the surface $\mathbf{14}_1$ is realized during casting of the concrete block $\mathbf{12}_j$ and may be based on a natural stone's surface which has been used to produce a mold for casting the concrete block $\mathbf{12}_j$. For ease of reference, the portion 16 of the surface $\mathbf{14}_1$ and its cast texture with a natural stone appearance will hereinafter be referred to as the "natural stone-like surface portion" 16.

Figure 4:
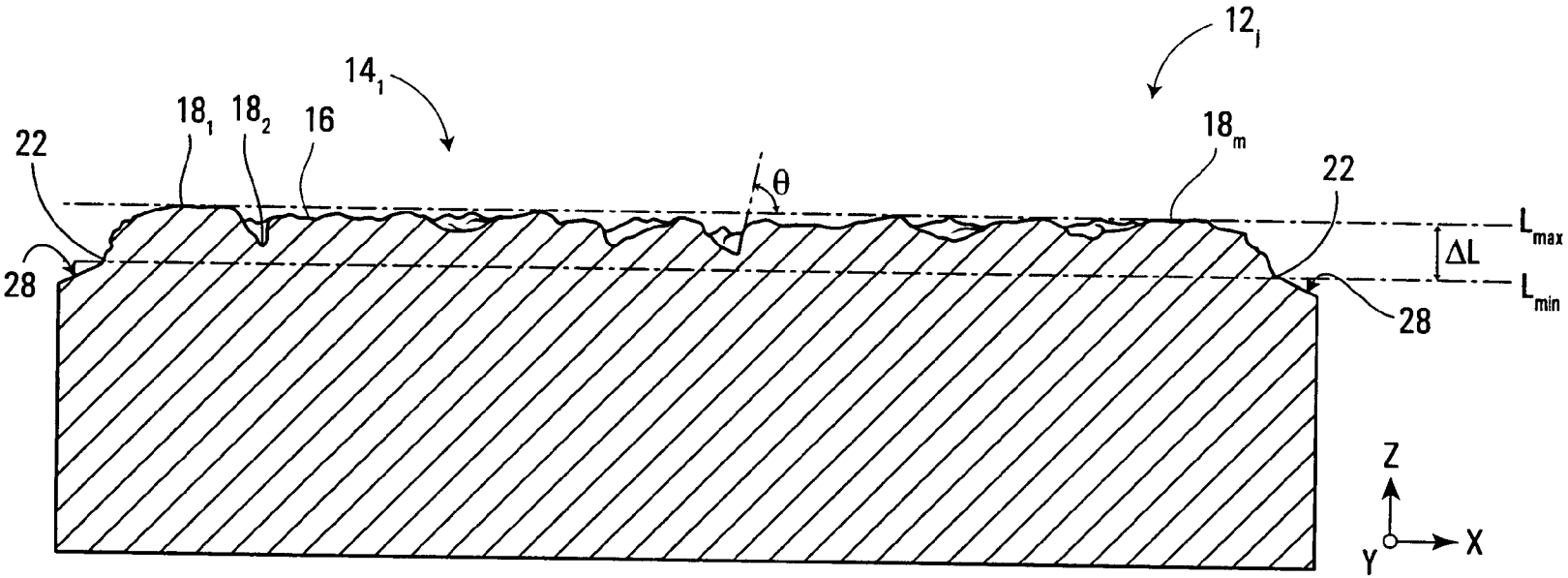
FIG. 4 illustrates a cross-sectional view of an embodiment where a surface portion of a concrete block that has a natural stone appearance is contiguous to a chamfered, rounded or otherwise non-natural looking edge portion of the concrete block.

The natural stone-like surface portion 16 has a visually discernible boundary 22. In the embodiment of FIGS. 2 and 3, the natural stone-like surface portion 16 substantially corresponds to the entire surface $\mathbf{14}_1$ with its boundary 22 substantially corresponding to edges of the surface $\mathbf{14}_1$. In other embodiments, the natural stone-like surface portion 16 may be only a limited portion of the surface $\mathbf{14}_1$ (i.e., not all of that surface), and, in some cases, may be one of a plurality of natural stone-like surface portions of the surface $\mathbf{14}_1$. Also, as shown in FIG. 4, in embodiments where the natural stone-like surface portion 16 is contiguous to a chamfered, rounded, or otherwise non-natural stone looking edge portion 28 of the concrete block $\mathbf{12}_j$ (e.g., an edge portion serving as a joint), the boundary 22 of the natural stone-like surface portion 16 is considered to be configured such that the chamfered, rounded or otherwise non-natural stone looking edge portion 28 is not part of the natural stone-like surface portion 16.

Continuing with FIGS. 2 and 3, the natural stone-like surface portion 16 includes a pattern of cast relief elements $\mathbf{18}_1 \ldots \mathbf{18}_M$ formed during casting of the concrete block $\mathbf{12}_j$. This pattern of cast relief elements $\mathbf{18}_1 \ldots \mathbf{18}_M$ includes a plurality of bumps or peaks and a plurality of valleys or depressions, which are sized so as to be visually distinguishable when the concrete block $\mathbf{12}_j$ is placed in the paved surface 10. It is to be understood that various other patterns of cast relief elements are possible. For example, FIGS. 6A to 6D illustrate various embodiments of concrete blocks each having a natural-stone like surface portion that includes a different pattern of cast relief elements.

The cast texture of the natural stone-like surface portion 16 defines a "surface level difference" $\Delta L$, which refers to the normal distance between a maximum level $L_{max}$ of that surface portion and a minimum level $L_{min}$ of that surface portion. As shown in FIG. 3, the concrete block $\mathbf{12}_j$ can be viewed as defining orthogonal X, Y and Z axes, where the X-Y plane is parallel to a plane that would be formed by the natural stone-like surface portion 16 if that surface portion was flat, i.e., the plane in which lies the boundary 22 of the natural stone-like surface portion 16. A level L at a given point of the natural stone-like surface portion 16 can be viewed as a plane parallel to the X-Y plane, and the surface level difference $\Delta L$ can be viewed as being measured along the Z axis.

Figure 5:
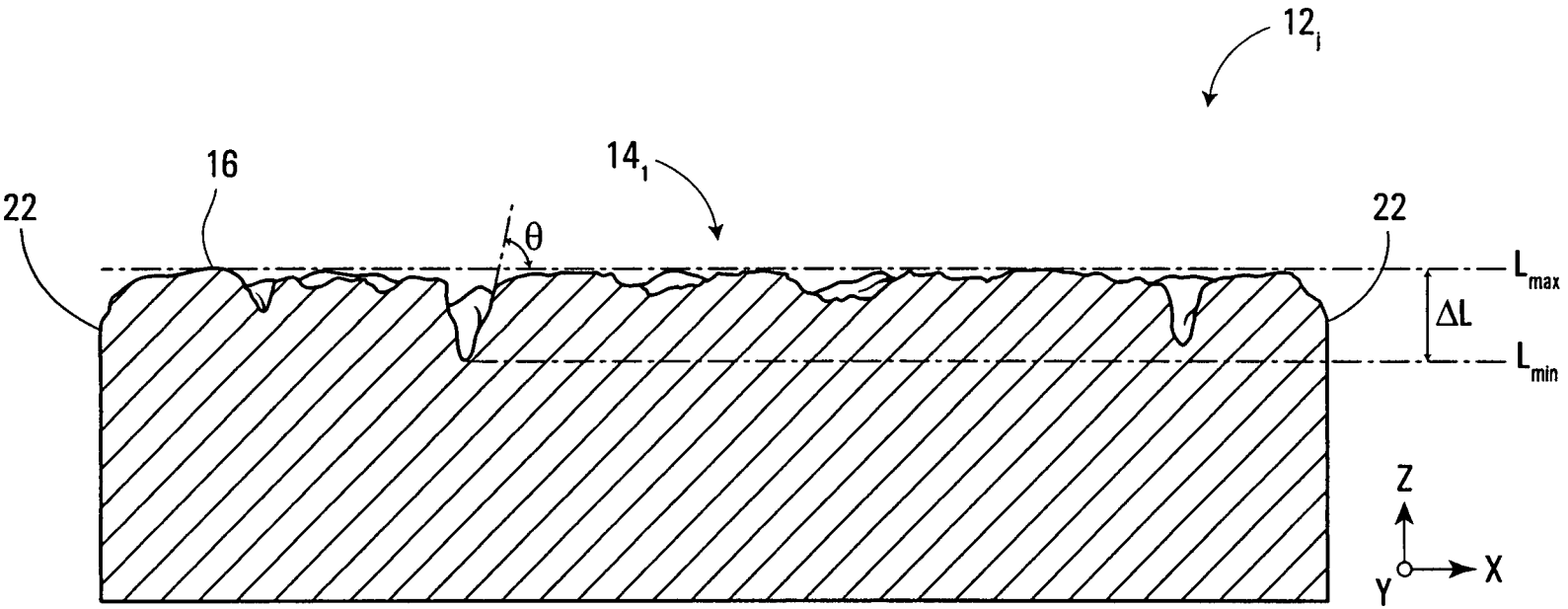
FIG. 5 illustrates a cross-sectional view of an embodiment in which a minimum level of a surface portion of a concrete block that has a natural stone appearance is not located at a boundary of that surface portion.
Figure 6A:
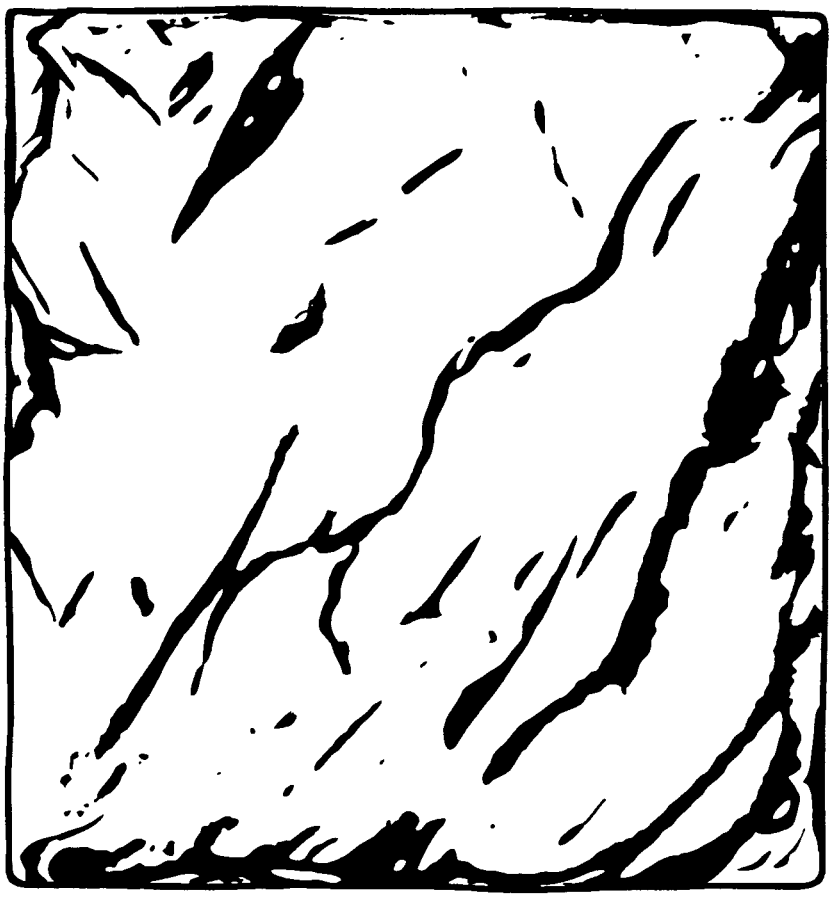
FIGS. 6A to 6D show various embodiments of concrete blocks each having a surface portion that comprises a different pattern of cast relief elements.
Figure 6B:
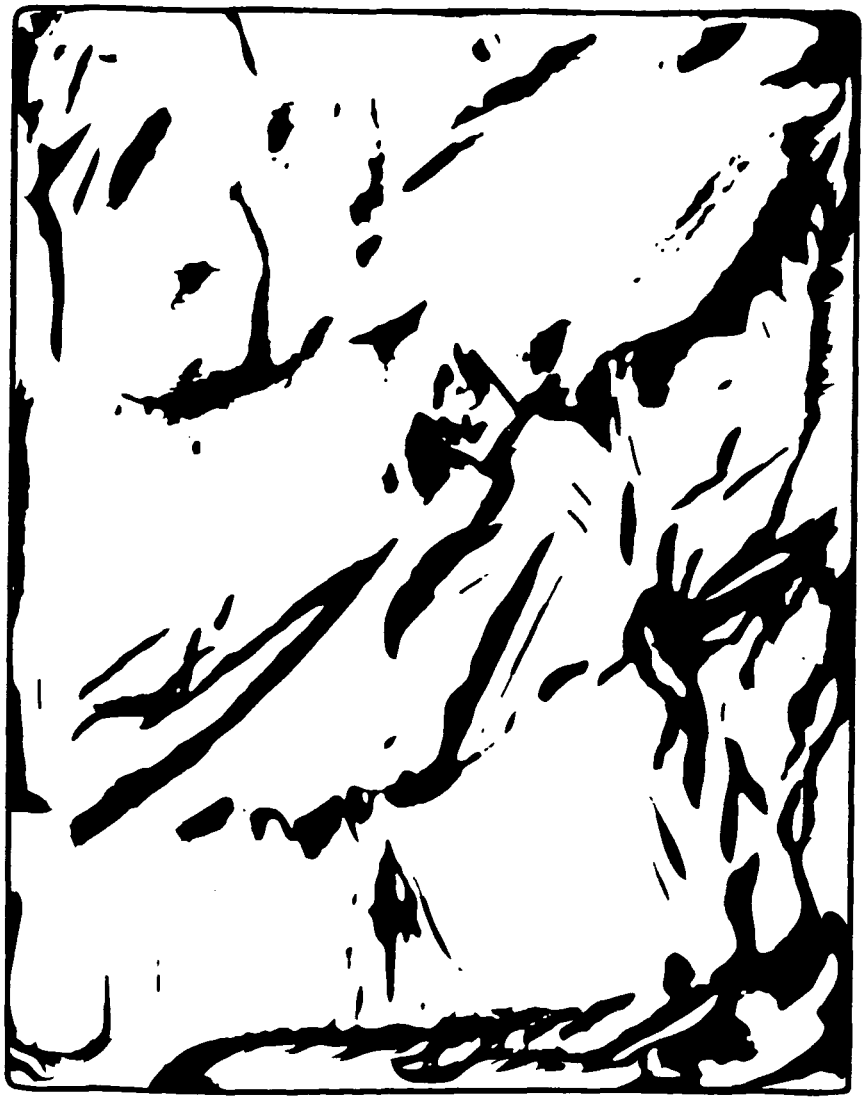
Figure 6C:
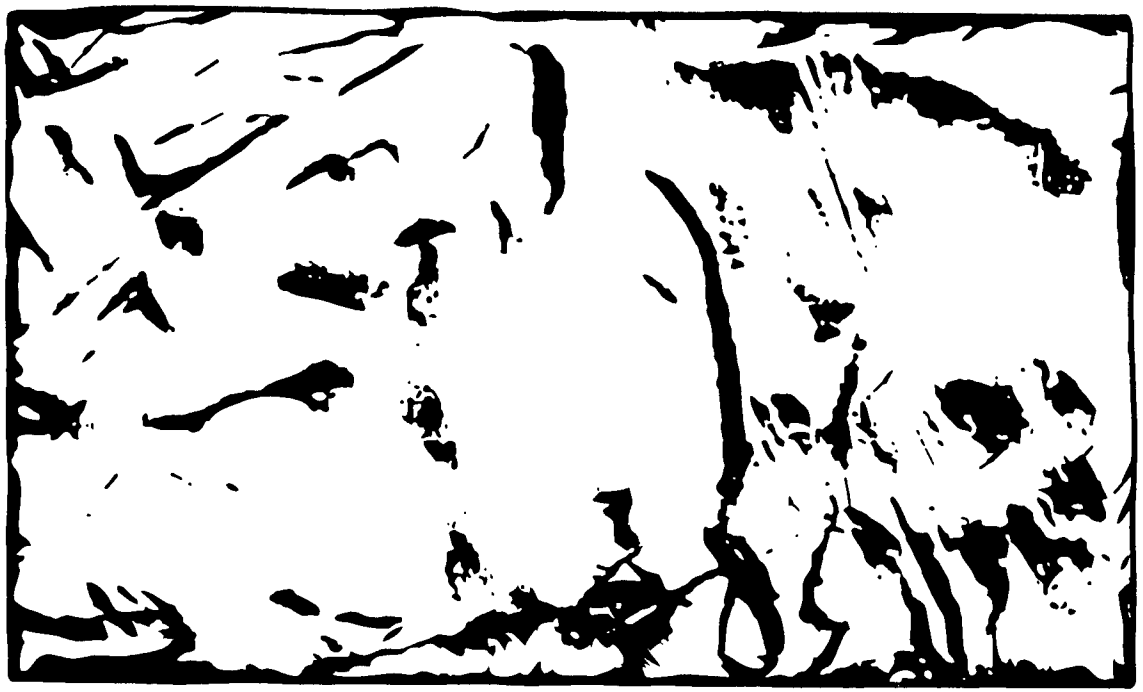
Figure 6D:
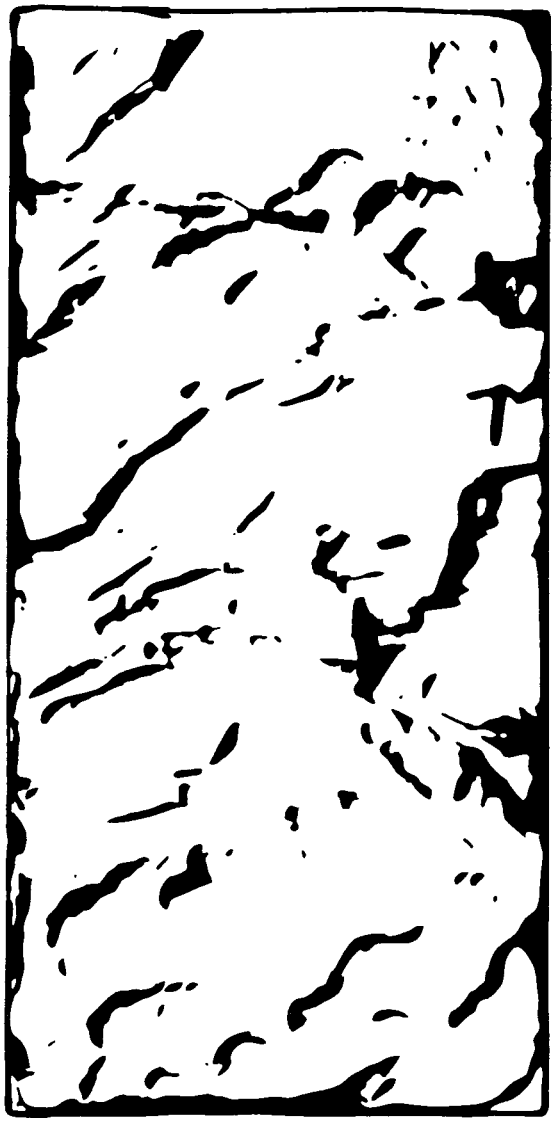

In the embodiment shown in FIGS. 2 and 3, the minimum level $L_{min}$ of the natural stone-like surface portion 16 is located at its boundary 22. Generally, the minimum level $L_{min}$ of the natural stone-like surface portion 16 may be located anywhere on that surface portion. For example, FIG. 5 illustrates an embodiment in which the minimum level $L_{min}$ of the natural stone-like surface portion 16 is not located at its boundary 22. The maximum level $L_{max}$ of the natural stone-like surface portion 16 may also be located anywhere on that surface portion, including at its boundary 22.

Returning to FIGS. 2 and 3, in this embodiment where the concrete block $\mathbf{12}_j$ is for use in a paving application, the surface level difference $\Delta L$ may greater than 6 mm, for example, between 6 mm and 12 mm. For instance, in one embodiment, the surface level difference $\Delta L$ may be about 8 mm. This enables the natural stone-like surface portion 16 to exhibit desired natural stone appearance characteristics, while maintaining a degree of surface irregularity suitable for supporting pedestrian or other traffic.

It is generally contemplated that a surface level difference $\Delta L$ of greater than 4 mm achieves satisfactory results in terms of natural stone appearance of a surface portion of a concrete block since it enables presence of visually distinguishable cast texture features mimicking surface texture of natural stone.

With continued reference to FIGS. 2 and 3, each of the cast relief elements $\mathbf{18}_1 \ldots \mathbf{18}_M$ of the natural stone-like surface portion 16 reaches a respective level L that is the maximum level $L_{max}$, the minimum level $L_{min}$, or a level therebetween. In this embodiment, a plurality of the cast relief elements $\mathbf{18}_1 \ldots \mathbf{18}_M$ are seen in FIG. 3 as extending to the maximum level $L_{max}$ of the natural stone-like surface portion 16 and separated from each other by other ones of the cast relief elements $\mathbf{18}_1 \ldots \mathbf{18}_M$ that only extend to lower levels. More particularly, the natural stone-like surface portion 16 is configured such that at least three of the cast relief elements $\mathbf{18}_1 \ldots \mathbf{18}_M$ extend to the maximum level $L_{max}$ and are positioned relative to each other to provide an effective support on which at least one other concrete block may be supported. In other words, the maximum level $L_{max}$ of the natural stone-like surface portion 16 provides at least three points that are located relative to each other such that at least one other concrete block may be supported thereon in a stable manner. This facilitates stacking or palletizing of concrete blocks for storage or transportation purposes.

Also, in this embodiment, each of the cast relief $\mathbf{18}_1 \ldots \mathbf{18}_M$ of the natural stone-like surface portion 16 that is a valley (e.g., the cast relief element $\mathbf{18}_2$) can be viewed as having a respective "depth" D, which refers to the normal distance between the maximum level $L_{max}$ of the surface portion 16 and that valley's deepest point. Depending on the surface level difference ΔL, in some embodiments, the respective depth D of each of one or more valleys of the natural stone-like surface portion 16 may be greater than 4 mm, for example, between 4 mm and 10 mm. This may further enhance natural stone appearance characteristics exhibited by the natural stone-like surface portion 16, while maintaining a degree of surface irregularity suitable for supporting pedestrian or other traffic.

Continuing with FIGS. 2 and 3, in this embodiment, the natural stone-like surface portion 16 interacts with ambient light to create shadows that further contribute to its natural stone appearance. More particularly, as shown in FIG. 3, each point of the cast texture of the natural stone-like surface portion 16 defines a respective "texture angle" θ, which refers to the angle between a plane parallel to the X-Y plane and a plane tangent to the natural stone-like surface portion 16 at that point.

In one embodiment, the respective texture angle θ of each of a plurality of points of the natural stone-like surface portion 16 may be between about 75° and about 90°. This may contribute to creation of shadows on the natural stone-like surface portion 16 that further enhance its natural stone appearance. Configuring a dry-cast concrete block with a surface level difference ΔL in the above-mentioned ranges has been found to facilitate, if not altogether render possible, formation of such texture angles θ during casting. It is noted, however, that the above-mentioned values of texture angle θ are presented for example purposes only and are not to be considered limiting in any respect.

Figure 7:
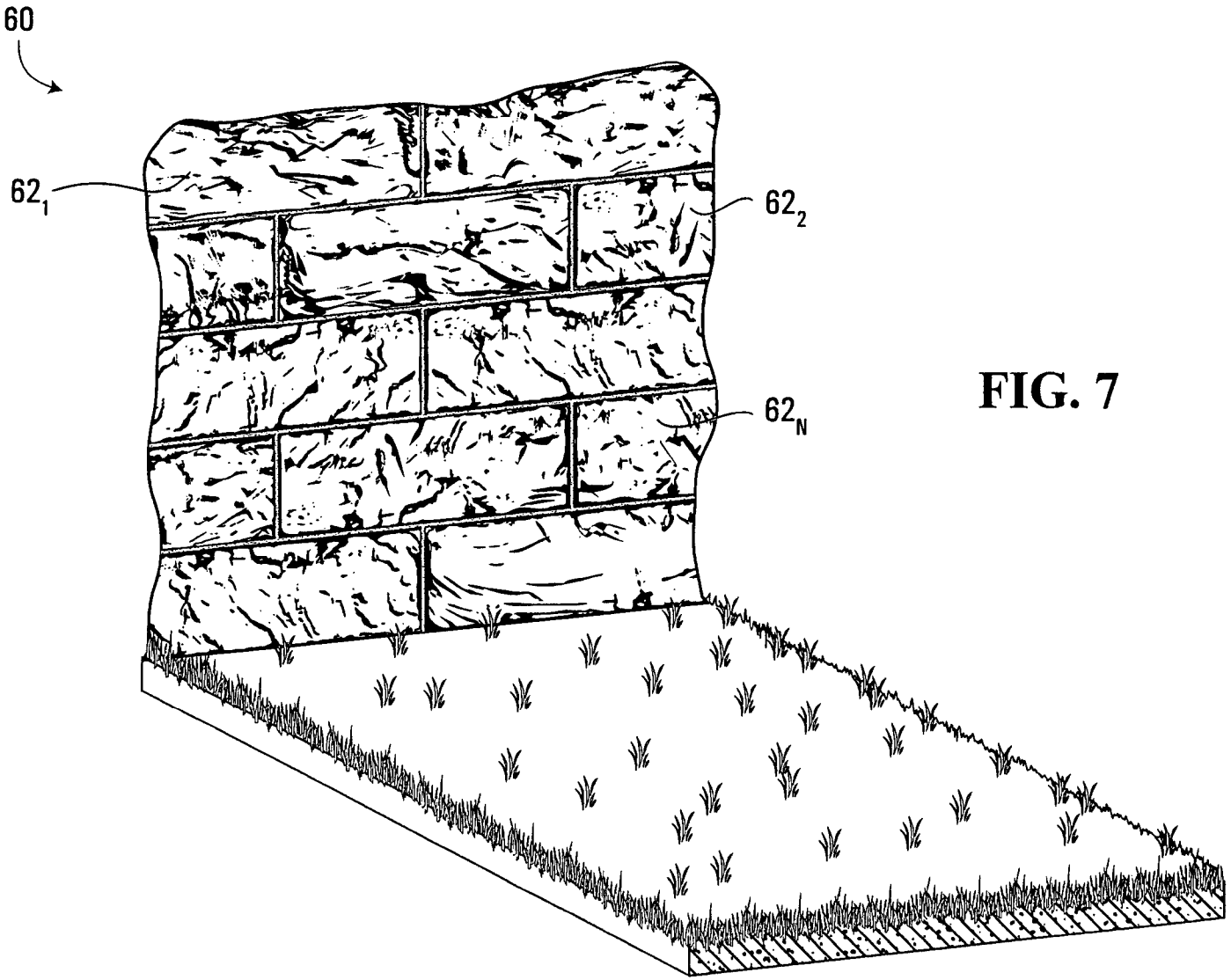
FIG. 7 shows a wall portion comprising a plurality of concrete blocks in accordance with a second embodiment of the invention.

Turning now to FIG. 7, there is shown a wall portion 60 comprising a plurality of concrete blocks $\mathbf{62}_1 \ldots \mathbf{62}_R$ in accordance with a second embodiment of the invention. In this embodiment, the concrete blocks $\mathbf{62}_1 \ldots \mathbf{62}_R$ are masonry units. In other embodiments, the concrete blocks $\mathbf{62}_1 \ldots \mathbf{62}_R$ may be retaining wall units. Generally, the concrete blocks $\mathbf{62}_1 \ldots \mathbf{62}_R$ may be any type of wall construction unit used in various types of walls, including building walls, retaining walls and other landscaping walls, acoustic walls, etc. The concrete blocks $\mathbf{62}_1 \ldots \mathbf{62}_R$ have a certain shape and size and are arranged in a certain laying pattern. Generally, the concrete blocks $\mathbf{62}_1 \ldots \mathbf{62}_R$ may have any desired shape and size, and may be arranged in any desired laying pattern.

Figure 8:
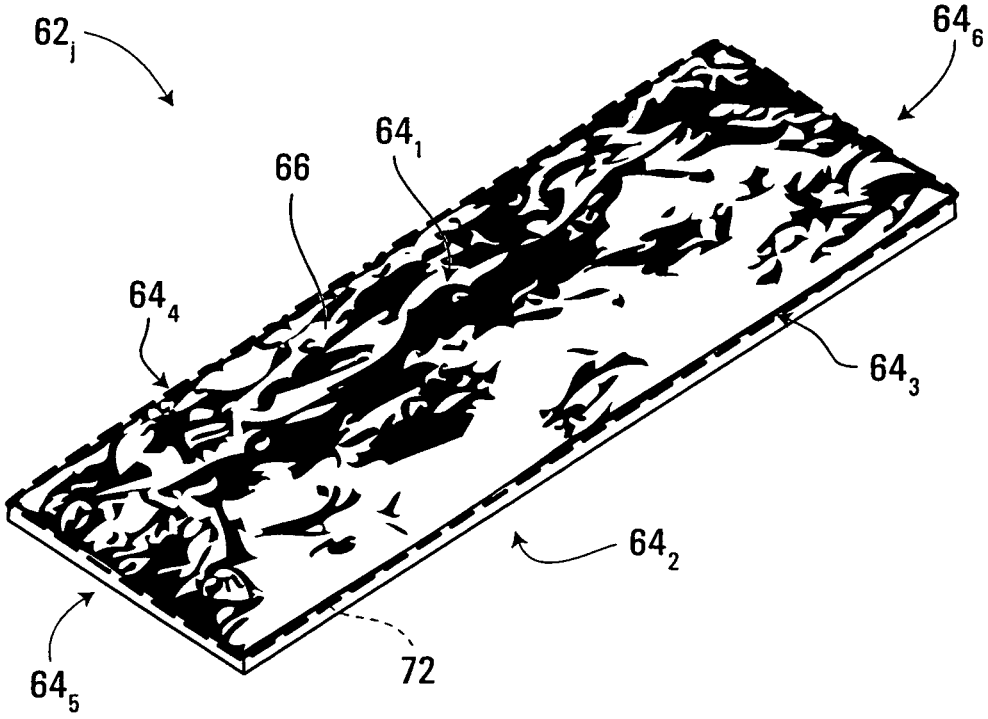
FIG. 8 shows a perspective view of a given concrete block of the concrete blocks shown in FIG. 7.

Referring to FIG. 8, there is shown a given concrete block $\mathbf{62}_j$ of the concrete blocks $\mathbf{62}_1 \ldots \mathbf{62}_N$ ($1 \leq j \leq R$). The concrete block $\mathbf{62}_j$ is a dry-cast concrete block having a generally rectangular prism configuration with six surfaces $\mathbf{64}_1 \ldots \mathbf{64}_6$. The concrete block $\mathbf{62}_j$ may, however, have any desired configuration with any desired number of surfaces.

Figure 9A:
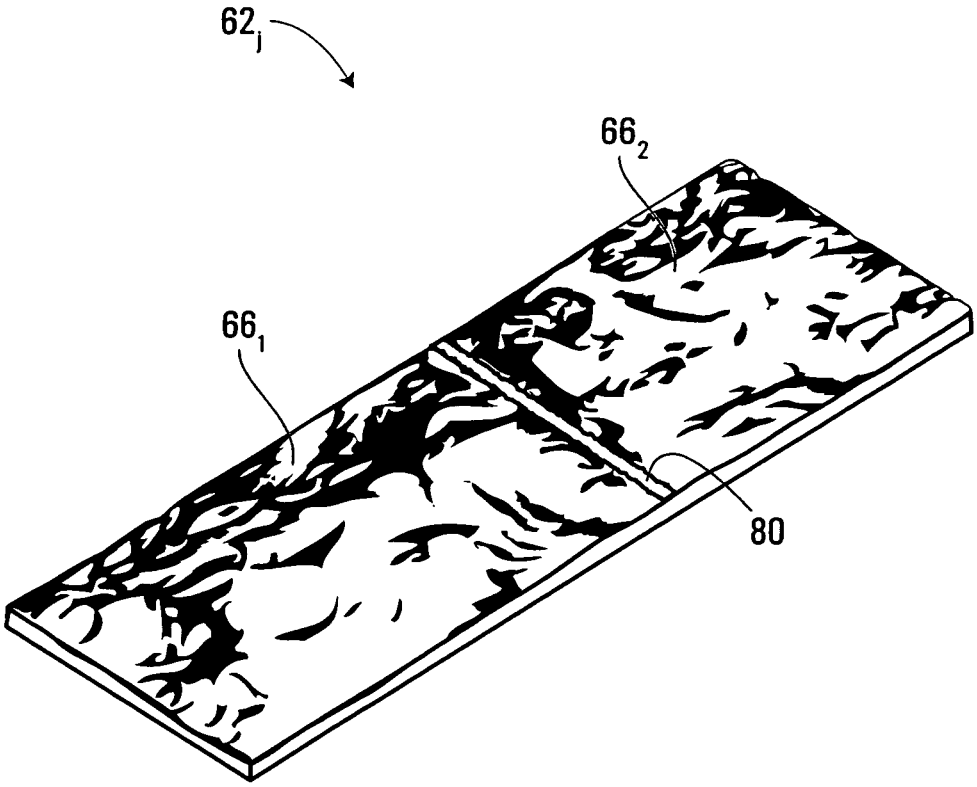
FIGS. 9A and 9B show embodiments in which a concrete block comprises a plurality of surface portions with a cast texture that has a natural stone appearance.
Figure 9B:
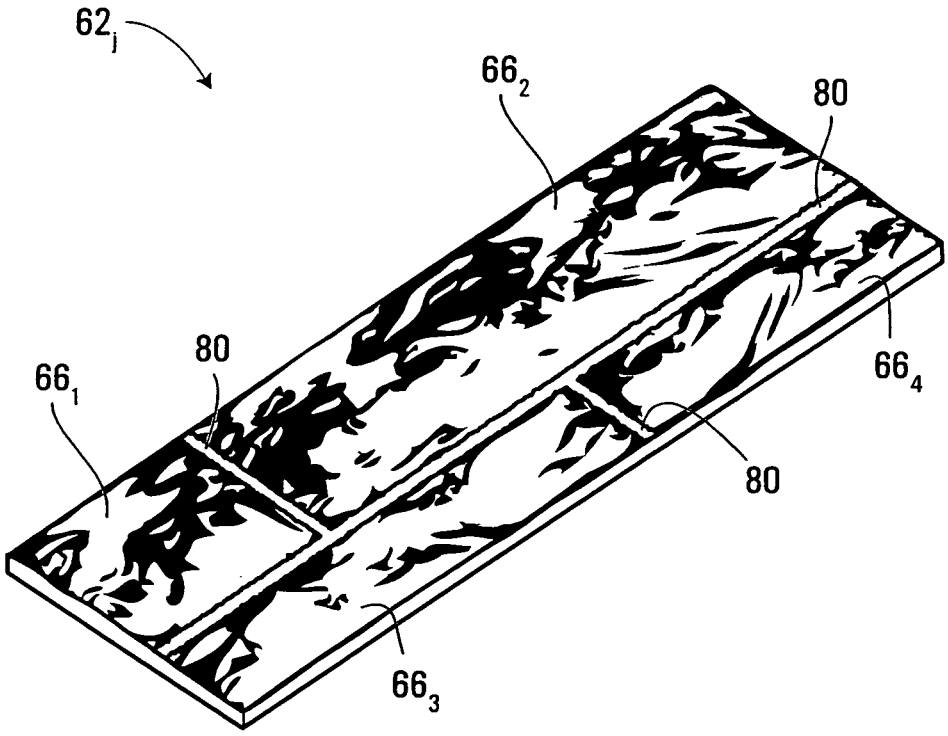

The surface $\mathbf{64}_1$ is intended to be exposed when the concrete block $\mathbf{62}_j$ is positioned in the wall portion 60. The surface $\mathbf{64}_1$ has a natural stone-like surface portion 66 with a cast texture having a natural stone appearance. The natural stone-like surface portion 66 has a visually discernible boundary 72. In this embodiment, the natural stone-like surface portion 66 substantially corresponds to the entire surface $\mathbf{64}_1$ with its boundary 72 substantially corresponding to edges of the surface $\mathbf{64}_1$. In other embodiments, the natural stone-like surface portion 66 may be only a limited portion of the surface $\mathbf{64}_1$ (i.e., not all of that surface). In yet other embodiments, the natural stone-like surface portion 66 may be one of a plurality of natural stone-like surface portions of the surface $\mathbf{64}_1$. For example, FIGS. 9A and 9B show embodiments in which are provided a plurality of natural stone-like surface portions $\mathbf{66}_1 \ldots \mathbf{66}_Q$ separated by a surface portion 80 that does not have a natural stone appearance and can serve as a false joint (where Q=2 in FIGS. 9A and Q=4 in FIG. 9B). Generally, any number of natural stone-like surface portions may be provided. Such a plurality of natural stone-like surface portions $\mathbf{16}_1 \ldots \mathbf{16}_Q$ results in a wall portion seeming to include several blocks of various sizes and configurations.

Returning to FIG. 8, the natural stone-like surface portion 66 includes a pattern of cast relief elements formed during casting of the concrete block $\mathbf{62}_j$. It is to be understood that various other patterns of cast relief elements are possible. For example, the natural stone-like surface portions $\mathbf{66}_1 \ldots \mathbf{66}_Q$ in FIGS. 9A and 9B illustrate various other examples of possible patterns of cast relief elements.

The cast texture of the natural stone-like surface portion 66 defines a surface level difference ΔL. In this embodiment, where the concrete block $\mathbf{62}_j$ is for use in a wall construction application, the surface level difference ΔL may be greater than 15 mm, for example, between 15 mm and 25 mm. For instance, in one embodiment, the surface level difference ΔL may be about 20 mm. The surface level difference ΔL can be generally greater for a wall construction application than for a paving application, since there is no requirement to maintain a degree of surface irregularity suitable for supporting pedestrian or other traffic.

As mentioned previously, for various applications including the above-described paving and wall construction applications, it is generally contemplated that a surface level difference ΔL of greater than 4 mm achieves satisfactory results in terms of natural stone appearance of a surface portion of a concrete block since it enables presence of visually distinguishable cast texture features mimicking surface texture of natural stone. Also, in embodiments such as those shown in FIGS. 9A and 9B, different ones of the natural stone-like surface portions $\mathbf{66}_1 \ldots \mathbf{66}_Q$ may define a common or distinct surface level difference ΔL and may have common or distinct maximum levels $L_{max}$ and minimum levels $L_{min}$.

With continued reference to FIG. 8, each of the cast relief elements of the natural stone-like surface portion 66 extends to a respective level L that is the maximum level $L_{max}$, the minimum level $L_{min}$, or a level therebetween. In this embodiment, a plurality of the cast relief elements extend to the maximum level $L_{max}$ of the natural stone-like surface portion 66 and are separated from each other by other ones of the cast relief elements that only extend to lower levels. More particularly, the natural stone-like surface portion 66 is configured such that at least three of the cast relief elements extend to the maximum level $L_{max}$ and are positioned relative to each other to provide an effective support on which at least one other concrete block may be supported. In other words, the maximum level $L_{max}$ of the natural stone-like surface portion 66 provides at least three points that are located relative to each other such that at least one other concrete block may be supported thereon in a stable manner. In embodiments such as those shown in FIGS. 9A and 9B, these at least three points may be distributed among the plurality of natural stone-like surface portions $\mathbf{66}_1 \ldots \mathbf{66}_Q$. As mentioned previously, this facilitates stacking or palletizing of concrete blocks for storage or transportation purposes.

Also, while not shown in this example, in other embodiments, the cast relief elements of the natural stone-like surface portion 66 may include one or more valleys each having a respective depth D that may be greater than 4 mm (e.g., between 4 mm and 10 mm), depending on the surface level difference ΔL. This may further enhance natural stone appearance characteristics exhibited by the natural stone-like surface portion 66.

Continuing with FIG. 8, each of a plurality of points of the cast texture of the natural stone-like surface portion 66 defines a respective texture angle θ that may be between about 75° and about 90°. This may contribute to creation of shadows on the natural stone-like surface portion 66 that further enhance its natural stone appearance. It is to be noted, however, that the above-mentioned values of texture angle θ are presented for example purposes only and are not to be considered limiting in any respect.

It will thus be appreciated that when the concrete blocks $\mathbf{12}_1 \ldots \mathbf{12}_N$ are positioned in the paved surface 10 (FIG. 1), each concrete block's natural stone-like surface portion 16 contributes to providing a natural and aesthetic look to the paved surface 10 while maintaining surface irregularity to a degree suitable for supporting pedestrian or other traffic. Similarly, when the concrete blocks $\mathbf{62}_1 \ldots \mathbf{62}_R$ are positioned in the wall portion 60 (FIG. 7), each concrete block's natural stone-like surface portion 66 contributes to providing a natural and aesthetic look to the wall portion 60. Furthermore, the natural stone appearance of each of the concrete blocks $\mathbf{12}_1 \ldots \mathbf{12}_N$ and $\mathbf{62}_1 \ldots \mathbf{62}_R$ is realized during casting of these concrete blocks, without requiring any subsequent mechanical artificial aging/weathering process (e.g., tumbling, splitting/breaking, object impacting, etc.). Moreover, since they are made of no-slump concrete, production time for the concrete blocks $\mathbf{12}_1 \ldots \mathbf{12}_N$ and $\mathbf{62}_1 \ldots \mathbf{62}_R$ may be significantly less than that required for wet-cast concrete blocks. Concrete blocks such as the concrete blocks $\mathbf{12}_1 \ldots \mathbf{12}_N$ and $\mathbf{62}_1 \ldots \mathbf{62}_R$ may therefore be mass-produced with high efficiency.

Although the above-described embodiments relate to concrete blocks for use in paving and wall construction applications, this is not to be considered limiting in any respect as concrete blocks in accordance with other embodiments of the invention may be used in various other types of applications, including steps construction, curb construction, and other landscaping applications.

Figure 10:
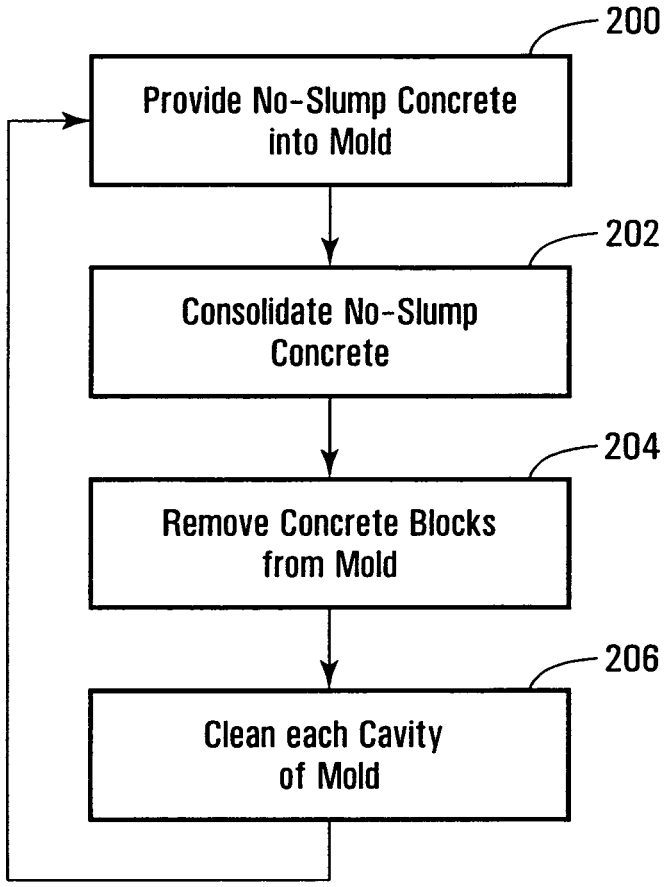
FIG. 10 is a flowchart illustrating an example of implementation of a process for manufacturing concrete blocks in accordance with embodiments of the invention.

Referring to FIG. 10, there is shown a flowchart illustrating an example of implementation of a process for manufacturing concrete blocks such as the above-described concrete blocks $\mathbf{12}_1 \ldots \mathbf{12}_N$ and $\mathbf{62}_1 \ldots \mathbf{62}_R$.

At step 200, no-slump concrete is placed into a mold. To facilitate mass-production, in one embodiment, the mold has a plurality of cavities. In other embodiments, a plurality of molds each with a single cavity or each with a respective plurality of cavities may be used. To further facilitate mass-production, the mold may be located such that concrete blocks are placed on a production board when removed therefrom.

Each cavity of the mold is configured to form a respective concrete block comprising a surface that includes a natural stone-like surface portion (e.g., the concrete block $\mathbf{12}_j$ with its natural stone-like surface portion 16 or the concrete block $\mathbf{62}_j$ with its natural stone-like surface portion 66). To that end, each cavity is defined in part by a surface of the mold that includes a portion with a surface texture corresponding to the desired natural stone appearance (hereinafter referred to as "the natural stone-like surface portion of the mold"). This surface portion thus defines a surface level difference ΔL' that corresponds to the desired surface level difference ΔL (FIG. 3) of the concrete block to be formed. Each point of this surface portion also defines a respective texture angle θ' corresponding to the desired texture angle θ (FIG. 4) of each point of the concrete block to be formed.

It will be appreciated that, in embodiments directed to producing concrete blocks with a plurality of natural stone-like surface portions (such as those shown in FIGS. 9A and 9B), each cavity of the mold that is intended to form such concrete blocks defines a corresponding plurality of natural stone-like surface portions.

In order to closely simulate natural stone, in one embodiment, each given natural stone-like surface portion of the mold, and thus the corresponding natural stone-like surface portion of concrete blocks to be formed by the mold, is based on a natural stone's surface. In one example of implementation, data representative of at least a portion of the natural stone's surface is obtained, for instance, via three-dimensional scanning of the natural stone's surface. The obtained data may then be computer processed using software in order to generate data representative of the given natural stone-like surface portion of the mold. In some cases, this processing may include modifying the obtained data representative of at least a portion of the natural stone's surface to set the desired surface level difference ΔL' and texture angles θ' of the given natural stone-like surface portion. This processing may also ensure that the data representative of the given natural stone-like surface portion of the mold will result in the corresponding natural stone-like surface portion of concrete blocks to be formed by the mold having at least three points that are located relative to each other such that at least one other concrete block may be supported thereon in a stable manner.

As another possible consideration, in embodiments where individual ones of the cavities of the mold are intended to form concrete blocks of similar overall dimensions (i.e., length, width and height) but with natural stone-like surface portions that have different configurations (e.g., different patterns of cast relief elements), these individual cavities may be designed to each have a common volume in order to facilitate production. In other words, a first cavity intended to form concrete blocks with natural stone-like surface portions having a first configuration may have a first volume, and a second cavity intended to form concrete blocks with natural stone-like surface portions having a second configuration different from the first configuration may have a second volume substantially corresponding to the first volume. This facilitates provision of substantially the same quantity of concrete into each cavity of the mold, which in turn facilitates efficient casting of concrete blocks in the mold and subsequent removal of the concrete blocks therefrom.

In embodiments where individual ones of the cavities of the mold are intended to form concrete blocks of significantly different overall dimensions (i.e., length, width and height) and with natural stone-like surface portions that have different configurations (e.g., different patterns of cast relief elements), similar production benefits may be achieved by designing these individual cavities to each have a common volume per unit area.

The mold may be manufactured via computer-aided manufacturing based on the data representative of each given natural stone-like surface portion of the mold. With no-slump concrete being used, the mold may be made of metal or other rigid material. There is no requirement for one or more portions of the mold to be made of elastomeric material (e.g., rubber), which is typically used in molds for casting wet-cast concrete blocks with a natural stone appearance.

Thus, during step 200, each cavity of the mold is filled with no-slump concrete in order to form a concrete block with at least one natural stone-like surface portion.

At step 202, the no-slump concrete in the mold is consolidated. Consolidation may include inducing vibration of the no-slump concrete in the mold so as to cause it to compact itself and closely conform to each cavity of the mold. A pre-vibration phase may be effected during step 200 to facilitate filling of the no-slump concrete in the mold and its eventual consolidation. Consolidation may also include application of pressure on the concrete in combination with its vibration. It will be appreciated that consolidation may be effected using various other techniques.

Upon completion of step 202, the no-slump concrete in each cavity of the mold has formed into a concrete block with at least one natural stone-like surface portion.

At step 204, the concrete block in each cavity of the mold is removed therefrom and continues on the production board. The concrete blocks may be directly stored for curing purposes. Since provision of a natural stone appearance is effected during casting, the concrete blocks do not require a subsequent mechanical artificial aging/weathering process (e.g., tumbling, splitting/breaking, object impacting, etc.) to impart them with such an appearance. Also, the concrete blocks may directly be stacked or palletized in a stable manner since the at least one natural stone-like surface portion of each concrete block has been configured to provide at least three points that are located relative to each other to ensure such stable supporting. With the concrete blocks being made of no-slump concrete, curing times are relatively short such that they are available for use within a short period of time (e.g., one day).

At step 206, each cavity of the mold is cleaned such that casting of new concrete blocks may be effected. In one embodiment, a cleaning unit uses a fluid to clean each cavity of the mold. The fluid may be a gas (e.g., compressed air) or a liquid whose flow relative to each cavity of the mold, and particularly each natural stone-like area of the mold, removes therefrom substantially any remaining no-slump concrete. Such a fluid-based cleaning action advantageously enables rapid cleaning of each cavity of the mold, thereby increasing production efficiency. In some cases, the cleaning unit may also use, in addition to the fluid, one or more brushes to clean each cavity of the mold, whereby the fluid-based cleaning action is combined with a brushing cleaning action. It will be appreciated that other embodiments may employ various other types of cleaning action.

As shown in FIG. 10, in this example, the process returns to step 200 where a new production cycle begins. In some embodiments, utilization of no-slump concrete in combination with rapid cleaning of the mold and other elements of the process may enable a production cycle to take a relatively short period of time (e.g., 15 to 20 seconds in some cases).

Although various embodiments and examples have been presented, this was for the purpose of describing, but not limiting, the invention. Various modifications and enhancements will become apparent to those of ordinary skill in the art and are within the scope of the present invention, which is defined by the attached claims.

The invention claimed is:

1. A dry-cast concrete block comprising a surface to be exposed, at least a portion of said surface having a cast texture with a natural stone appearance, wherein each of a plurality of points of said cast texture defines a respective texture angle between 75° and 90° and wherein said cast texture comprises a plurality of peaks and valleys and at least one of said valleys has a depth greater than 4 mm.

2. A dry-cast concrete block as claimed in claim 1, wherein said cast texture has a surface level difference of greater than 4 mm.

3. A dry-cast concrete block as claimed in claim 2, wherein said cast texture includes a pattern of cast relief elements configured to enable a second concrete block to be supported thereon.

4. A dry-cast concrete block as claimed in claim 2, wherein said at least a portion of said surface is a first portion of said surface and said cast texture is a first cast texture, said surface including (1) a second portion with a second cast texture having a natural stone appearance and (2) a third portion without a natural stone appearance and separating said first portion and said second portion, said second cast texture defining a surface level difference of greater than 4 mm.

5. A dry-cast concrete block as claimed in claim 1, wherein said cast texture has a surface level difference of greater than 6 mm.

6. A dry-cast concrete block as claimed in claim 1, wherein said cast texture has a surface level difference of between 6 mm and 12 mm.

7. A dry-cast concrete block as claimed in claim 1, wherein said cast texture has a surface level difference of greater than 15 mm.

8. A dry-cast concrete block as claimed in claim 1, wherein said cast texture has a surface level difference of between 15 mm and 25 mm.

9. A dry-cast concrete block as claimed in claim 1, wherein said dry-cast concrete block is a paving unit.

10. A dry-cast concrete block as claimed in claim 1, wherein said dry-cast concrete block is a wall construction unit.

11. A dry-cast concrete block as claimed in claim 1, wherein at least one of said valleys has a depth between 4 mm and 10 mm.

12. A dry-cast concrete block as claimed in claim 1, wherein said cast texture includes a pattern of cast relief elements configured to enable a second concrete block to be supported thereon.

13. A dry-cast concrete block as claimed in claim 12, wherein said pattern of cast relief elements includes at least three cast relief elements (i) extending to a maximum level of said cast texture; (ii) separated from each other by other ones of said cast relief elements that only extend to lower levels of said cast texture; and (iii) configured to enable the second concrete block to be supported thereon.

14. A dry-cast concrete block as claimed in claim 1, wherein said at least a portion of said surface is an entirety of said surface.

15. A dry-cast concrete block as claimed in claim 1, wherein said at least a portion of said surface is a first portion of said surface and said cast texture is a first cast texture, said surface including (1) a second portion with a second cast texture having a natural stone appearance and (2) a third portion without a cast texture having a natural stone appearance and that separates said first portion and said second portion.

16. A dry-cast concrete block comprising a surface to be exposed, at least a portion of said surface having a cast texture with a natural stone appearance, said cast texture comprising a plurality of peaks and valleys, at least one of said valleys having a depth greater than 4 mm and a side extending along a valley plane, a texture angle of between 75° and 90° being defined between said valley plane and an imaginary plane perpendicular to a thickness axis of said dry-cast concrete block.

17. A dry-cast concrete block as claimed in claim 16, wherein said cast texture has a surface level difference of greater than 4 mm.

18. A dry-cast concrete block as claimed in claim 16, wherein said at least a portion of said surface is a first portion of said surface and said cast texture is a first cast texture, said surface including (1) a second portion with a second cast texture having a natural stone appearance and (2) a third portion without a natural stone appearance and separating said first portion and said second portion, said second cast texture comprising a plurality of peaks and valleys wherein at least one of said valleys has a depth greater than 4 mm.

19. A dry-cast concrete block as claimed in claim 16, wherein at least one of said valleys has a depth between 4 mm and 10 mm.

20. A dry-cast concrete block as claimed in claim 16, wherein said dry-cast concrete block is a paving unit.

21. A dry-cast concrete block as claimed in claim 16, wherein said dry-cast concrete block is a wall construction unit.

22. A dry-cast concrete block comprising a surface to be exposed, at least a portion of said surface having a cast texture with a natural stone appearance, said cast texture comprising a plurality of peaks and valleys wherein at least one of said valleys has a depth greater than 4 mm and wherein at least one of said valleys has a side extending along a valley plane, a texture angle of between 75° and 90° being defined between said valley plane and an imaginary plane perpendicular to a thickness axis of said dry-cast concrete block.

23. A dry-cast concrete block as claimed in claim 22, wherein said cast texture has a surface level difference of greater than 6 mm.

24. A dry-cast concrete block as claimed in claim 22, wherein said at least a portion of said surface is a first portion of said surface and said cast texture is a first cast texture, said surface including (1) a second portion with a second cast texture having a natural stone appearance and (2) a third portion without a natural stone appearance and separating said first portion and said second portion, said second cast texture comprising a plurality of peaks and valleys wherein at least one of said valleys of said second cast texture has a depth greater than 4 mm.

25. A dry-cast concrete block as claimed in claim 22, wherein said dry-cast concrete block is a paving unit.

26. A dry-cast concrete block as claimed in claim 22, wherein said dry-cast concrete block is a wall construction unit.

27. A dry-cast concrete block made by a dry-casting process, said dry-cast concrete block comprising a surface to be exposed, at least a portion of said surface having a cast texture with a natural stone appearance, said cast texture comprising a pattern of cast relief elements formed during the dry-casting process wherein said pattern of cast relief elements defines a plurality of peaks and valleys, at least one of said valleys having a depth greater than 4 mm and a side extending along a valley plane, a texture angle of between 75° and 90° being defined between said valley plane and an imaginary plane perpendicular to a thickness axis of said dry-cast concrete block.

28. A dry-cast concrete block as claimed in claim 27, wherein said cast texture has a surface level difference of greater than 4 mm.

29. A dry-cast concrete block as claimed in claim 27, wherein said cast texture has a surface level difference of greater than 15 mm.

30. A dry-cast concrete block as claimed in claim 27, wherein said at least a portion of said surface is a first portion of said surface, said cast texture is a first cast texture and said pattern of cast relief elements is a first pattern of cast relief elements, said surface including (1) a second portion with a second cast texture having a natural stone appearance and (2) a third portion without a natural stone appearance and separating said first portion and said second portion, said second cast texture comprising a second pattern of cast relief elements formed during the dry-casting process.

31. A dry-cast concrete block as claimed in claim 27, wherein said dry-cast concrete block is a paving unit.

32. A dry-cast concrete block as claimed in claim 27, wherein said dry-cast concrete block is a wall construction unit.

* * * * *